US009713383B2

(12) United States Patent
Hsu

(10) Patent No.: US 9,713,383 B2
(45) Date of Patent: Jul. 25, 2017

(54) BALL CHAIR

(71) Applicant: CHIA LIN SPORT CO., LTD., Homei Town., Chang-Hwa-Hsien (TW)

(72) Inventor: Chih-Chan Hsu, Chang-Hwa-Hsien (TW)

(73) Assignee: Chia Lin Sport Co., Ltd., Homei Town, Chang-Hwa-Hsien (TW)

( * ) Notice: Subject to any disclaimer, the term of this patent is extended or adjusted under 35 U.S.C. 154(b) by 172 days.

(21) Appl. No.: 14/730,661

(22) Filed: Jun. 4, 2015

(65) Prior Publication Data

US 2016/0353894 A1 Dec. 8, 2016

(51) Int. Cl.

| | |
|---|---|
| ***A47C 7/02*** | (2006.01) |
| ***A47C 7/00*** | (2006.01) |
| ***A47C 9/00*** | (2006.01) |
| ***A47C 4/54*** | (2006.01) |
| ***A47C 7/42*** | (2006.01) |

(52) U.S. Cl.

CPC ..... *A47C 7/002* (2013.01); *A47C 4/54* (2013.01); *A47C 7/42* (2013.01); *A47C 9/002* (2013.01)

(58) Field of Classification Search

CPC ..... A47C 9/002; A47C 7/002; A47C 7/02
See application file for complete search history.

(56) References Cited

U.S. PATENT DOCUMENTS 5,690,389 A * 11/1997 Ekman ..... A47C 3/16 248/599
6,070,943 A * 6/2000 Guery-Strahm ..... A47C 3/16 297/440.1
6,390,559 B1 * 5/2002 Schnitzhofer ..... A47C 3/16 297/226
6,447,070 B1 * 9/2002 Ekman ..... A47C 3/16 297/344.12
6,520,578 B1 * 2/2003 Jospa ..... A61G 15/005 297/217.1
D471,371 S * 3/2003 Chiu ..... D6/366
6,616,238 B1 * 9/2003 Guery-Strahm ..... A47C 9/002 297/440.1
6,702,388 B1 * 3/2004 Chiu ..... A47C 4/54 297/217.1
6,730,005 B1 * 5/2004 Liao ..... A47C 3/16 446/220
6,746,372 B2 * 6/2004 Hsu ..... A47C 9/002 482/123

(Continued)

*Primary Examiner* — David R Dunn
*Assistant Examiner* — Tania Abraham
(74) *Attorney, Agent, or Firm* — Muncy, Geissler, Olds & Lowe, P.C.

(57) ABSTRACT

A ball chair includes a ball-shaped cushion, a seat, a back and at least a threaded fastening member. The seat has a bearing portion for bearing the cushion, and a connecting portion connected with the bearing portion and having an engaging recess and at least a through hole communicating with the engaging recess. The back has an engaging block inserted in the engaging recess and having at least two relatively larger protrusions, at least a relatively smaller protrusion located between the two relatively larger protrusions, and at least a threaded hole provided in the relatively smaller protrusion and corresponding in position to the through hole. The threaded fastening member is inserted through the through hole and fixed in the threaded hole to fix the back to the seat.

8 Claims, 6 Drawing Sheets

(56) References Cited

U.S. PATENT DOCUMENTS

| | | | | |
|---|---|---|---|---|
| 6,832,817 | B1 * | 12/2004 | Chiu | A47C 4/54<br>16/43 |
| 7,044,558 | B2 * | 5/2006 | Chiu | A47C 4/54<br>297/217.1 |
| 2004/0256532 | A1 * | 12/2004 | Liao | A47C 3/16<br>248/346.01 |

* cited by examiner

BALL CHAIR

BACKGROUND OF THE INVENTION

1. Field of the Invention

The present invention relates generally to chairs and more particularly, to a ball chair.

2. Description of the Related Art

The conventional ball chair is primarily composed of a back, a seat, and a circular-ball-shaped cushion. However, in some conventional ball chairs, the juncture of the back and the seat is too complicated in structure, resulting in difficulty in assembling the back and the seat with each other. In other conventional ball chairs, the connecting strength between the back and the seat may be not strong enough to withstand the pressure exerting on the back of the ball chair by the back of the user who sits on the ball chair and leans his/her back on the back of the ball chair, resulting in that the juncture of the back and the seat is liable to have structural damage or even resulting in separation of the back from the seat. This brings the user who sits on the ball chair a certain danger. Besides, the circular-ball-shaped cushion of the conventional ball chair is too different in shape from the hips of the user to conform with ergonomics, resulting in uncomfortableness of the user.

SUMMARY OF THE INVENTION

The present invention has been accomplished in view of the above-noted circumstances. It is an objective of the present invention to provide a ball chair which is firm in structure, easy in assembling, relatively more conformable with ergonomics, and relatively more comfortable to the user who sits on the ball chair.

To attain the above objective, the present invention provides a ball chair which comprises a ball-shaped cushion, a seat, a back and at least one threaded fastening member. The seat has a bearing portion supporting the cushion, and a connecting portion connected with the bearing portion and having an engaging recess and at least one through hole communicated with the engaging recess. The back has an engaging block inserted in the engaging recess and having at least two relatively larger protrusions spaced from each other, at least a relatively smaller protrusion located between the at least two relatively larger protrusions, and at least one threaded hole provided at the at least one relatively smaller protrusion and corresponding in position to the through hole of the connecting portion of the seat. The at least one threaded fastening member has a head and a body extending from the head, inserted through the through hole of the connecting portion and engaged in the threaded hole of the engaging block for fixing the back to the seat.

In the aforesaid ball chair, the cushion may be shaped as an elliptic ball. The ball chair is firm in structure, easy in assembling, and relatively more conformable with ergonomics, thereby bringing the user convenience, safety and comfortableness.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
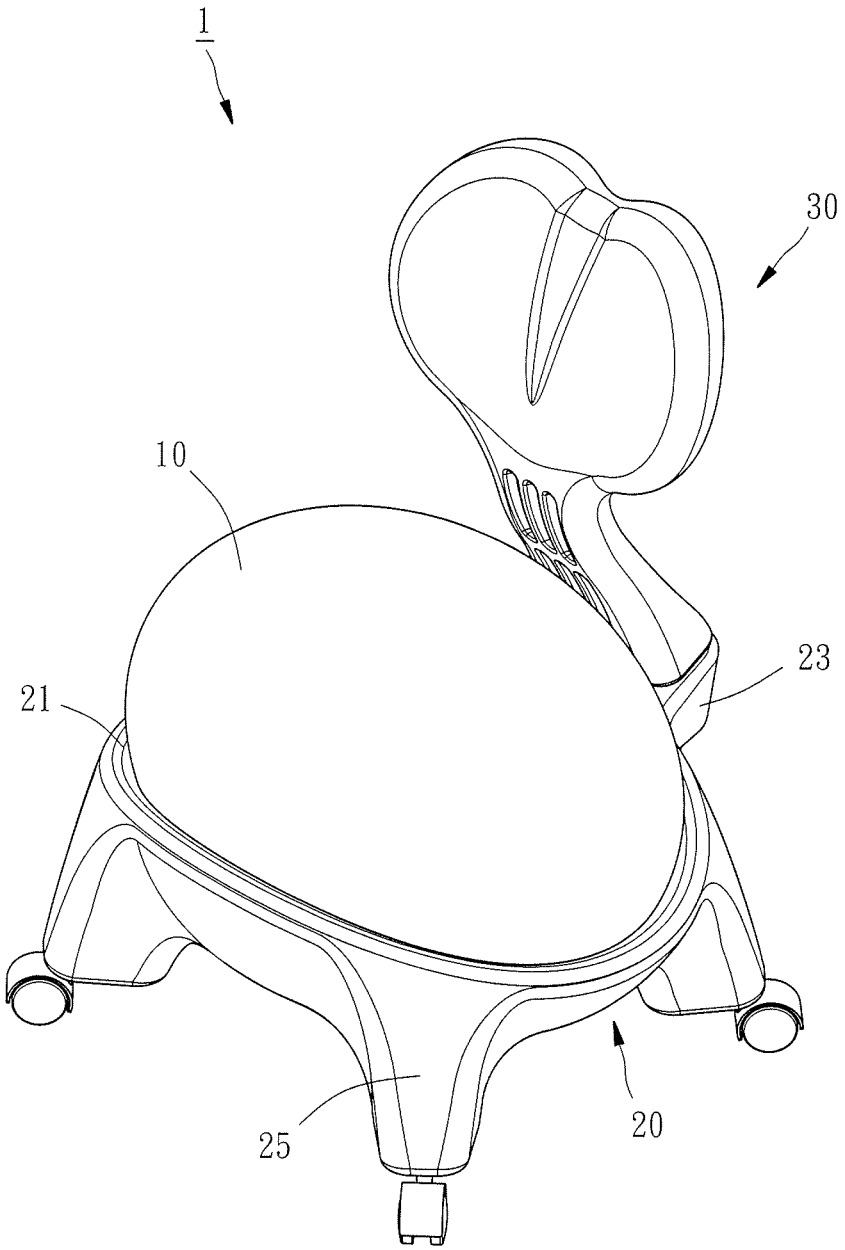
FIG. 1 is a perspective view of a ball chair according to an embodiment of the present invention.

Referring to FIGS. 1-6, a ball chair 1 according to an embodiment of the present invention is shown comprising a cushion 10, a seat 20, a back 30, and two threaded fastening members 40.

The cushion 10 has a ball shape. In this embodiment, the cushion 10 is approximately shaped like an elliptic ball.

Figure 6:
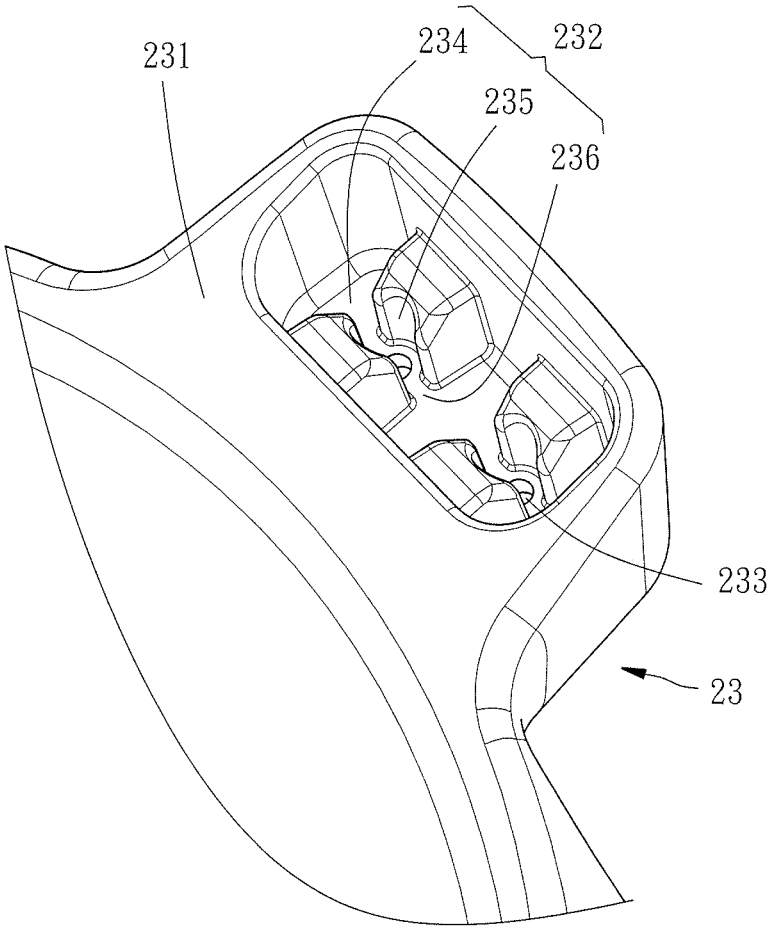
FIG. 6 is a perspective view of a part of the seat of the ball chair according to the embodiment of the present invention.

The seat 20 has a bearing portion 21 for supporting the cushion 10, a connecting portion 23 connected to the rear side of the bearing portion 21, and four feet 25 extending downwards from the peripheral of the bearing portion 21. As shown in FIG. 6, the connecting portion 23 has a lower stop surface 231 at the top thereof, an engaging recess 232 concaved from the lower stop surface 231, and two through holes 233 substantially perpendicularly penetrating through the bottom of the connecting portion 23 and communicating with the engaging recess 232. Wherein, the engaging recess 232 has three relatively larger cavities 234, two relatively smaller cavities 235 each located between two adjacent said relatively larger cavities 234, and four passages 236. Two of the passages 236 are located at two sides of one of the relatively smaller cavities 235 respectively and communicated with two adjacent relatively larger cavities 234 respectively. The other two passages 236 are located at two sides of the other relatively smaller cavity 235 respectively and communicated with two adjacent relatively larger cavities 234 respectively. The two through holes 233 are located in the two relatively smaller cavities 235, respectively. Besides, the bearing portion 21 in this embodiment is ring-shaped and approximately corresponds in shape to the cushion 10. In addition, the bearing portion 21 has an inner annular surface 211 which is cone-shaped and defined with a space gradually narrowing from top to bottom, so that the inner annular surface 211 is suitable for contacting a part of the cushion 10.

Figure 3:
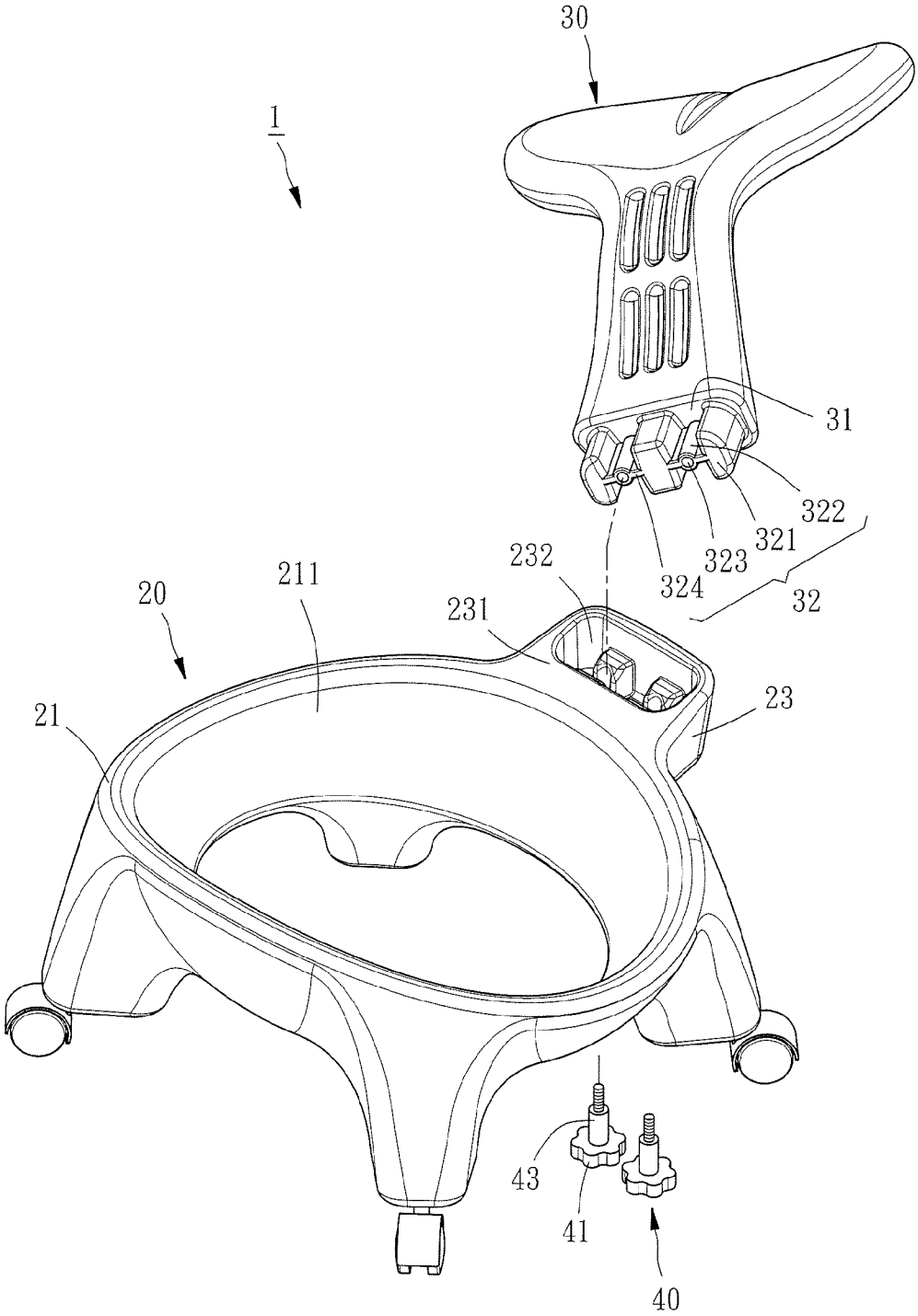
FIG. 3 is an exploded perspective view of the seat, the back and two threaded fastening members of the ball chair according to the embodiment of the present invention.

As shown in FIG. 3, the back 30 has an upper stop surface 31 at the bottom thereof, and an engaging block 32 protruded downwards from the upper stop surface 31 and inserted in the engaging recess 232. The engaging block 32 has three relatively larger protrusions 321 distanced from each other and accommodated in the three relatively larger cavities 234 respectively, two relatively smaller protrusions 322 each located between two adjacent relatively larger protrusions 321 and accommodated in the two relatively smaller cavities 235 respectively, two threaded holes 323 provided in the two relatively smaller protrusions 322 respectively and corresponding in position to the two through holes 233 of the connecting portion 23 of the seat 20, and four ribs 324. Two of the ribs 324 are extended from two sides of one of the relatively smaller protrusions 322 respectively and connected with two adjacent relatively larger protrusions 321. The other two ribs 324 are extended from two sides of the other relatively smaller protrusion 322 respectively and connected with two adjacent relatively larger protrusions 321. The four ribs 324 are accommodated in the four passages 236 of the engaging recess 232, respectively.

Each of the two threaded fastening members 40 has a head 41 and a body 43 extending from the center of the head 41 and having a threaded section. The two bodies 43 are inserted through the two through holes 233 of the connecting portion 23 respectively. The threaded sections of the two bodies 43 are screwingly threaded into the two threaded holes 323 of the engaging block 32 so that the back 30 is fixed to the seat 20 by the threaded fastening members 40.

Figure 2:
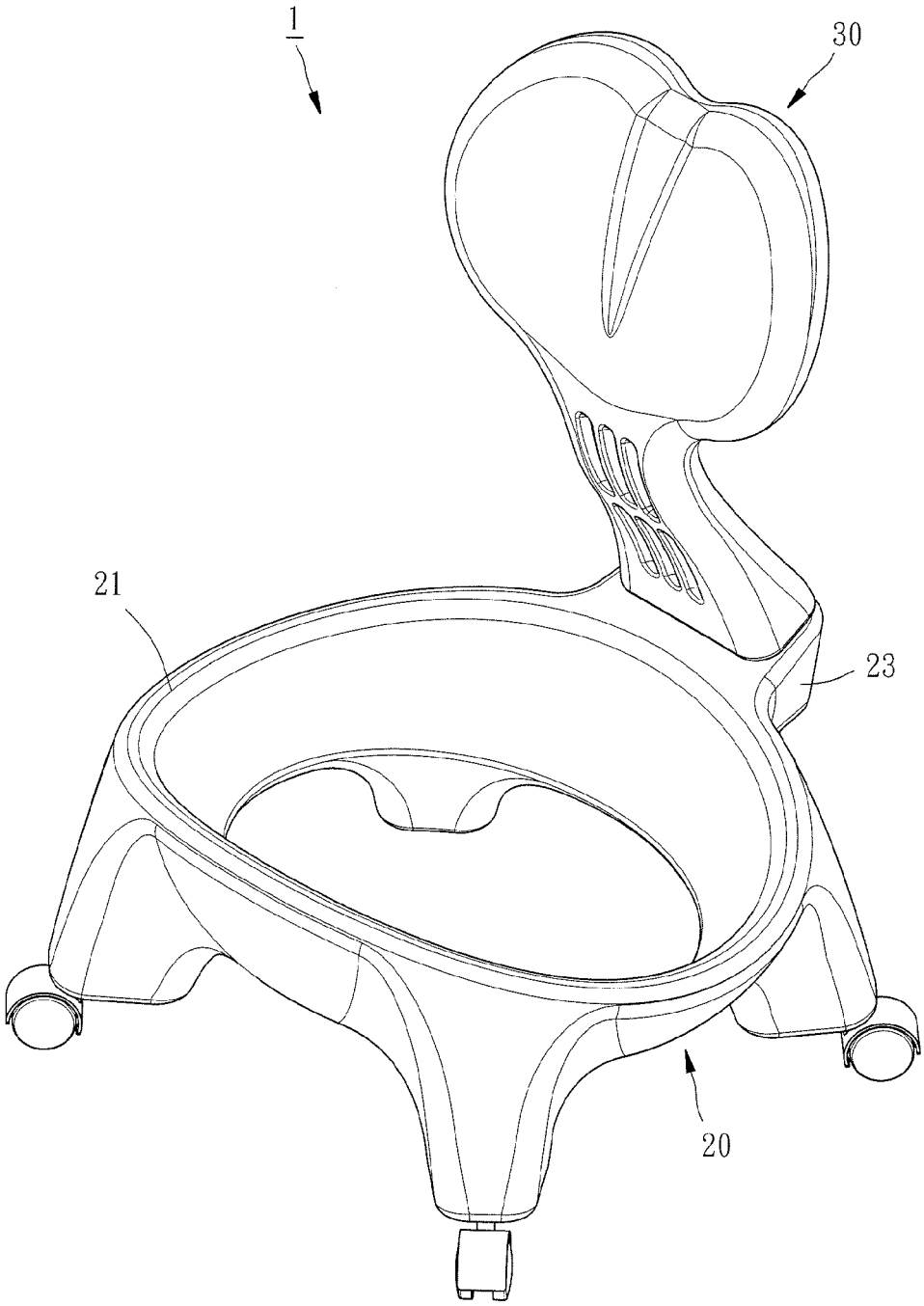
FIG. 2 is an assembled perspective view of a seat and a back of the ball chair according to the embodiment of the present invention.
Figure 4:
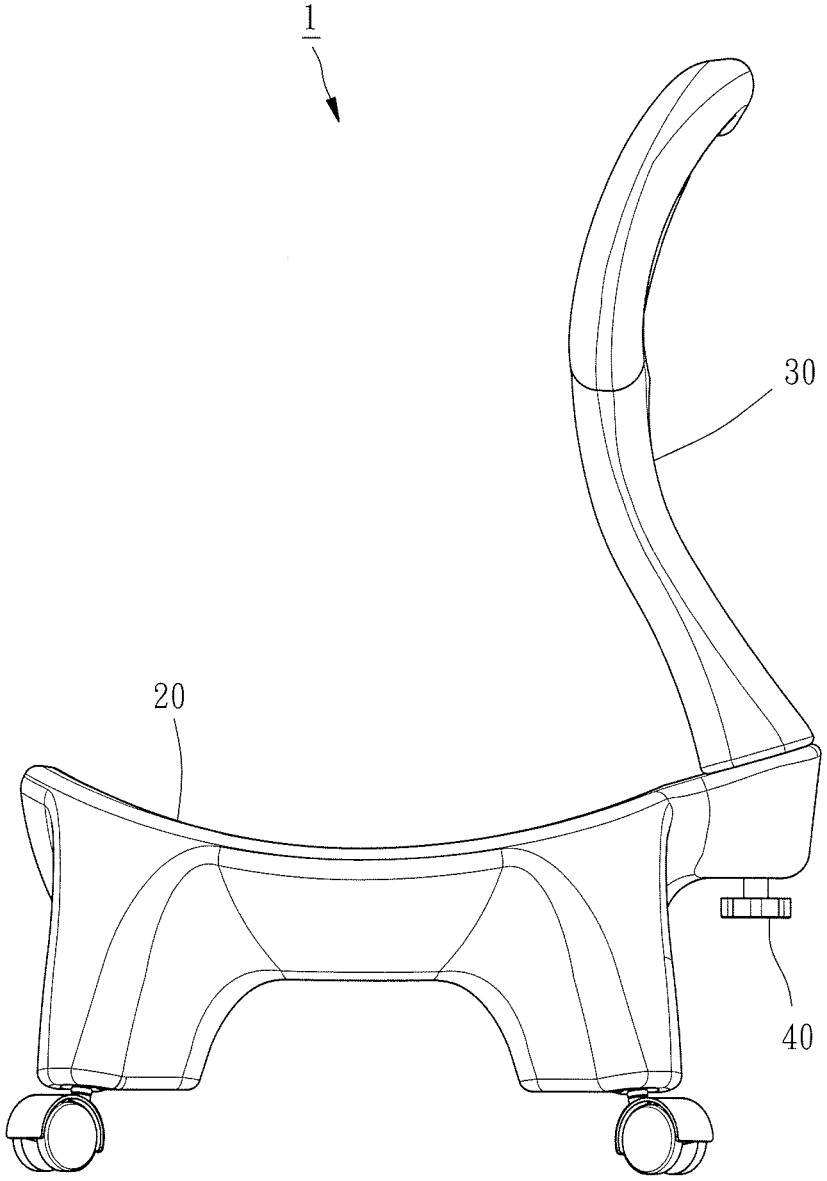
FIG. 4 is a lateral view of the seat, the back and the threaded fastening members of the ball chair according to the embodiment of the present invention.
Figure 5:
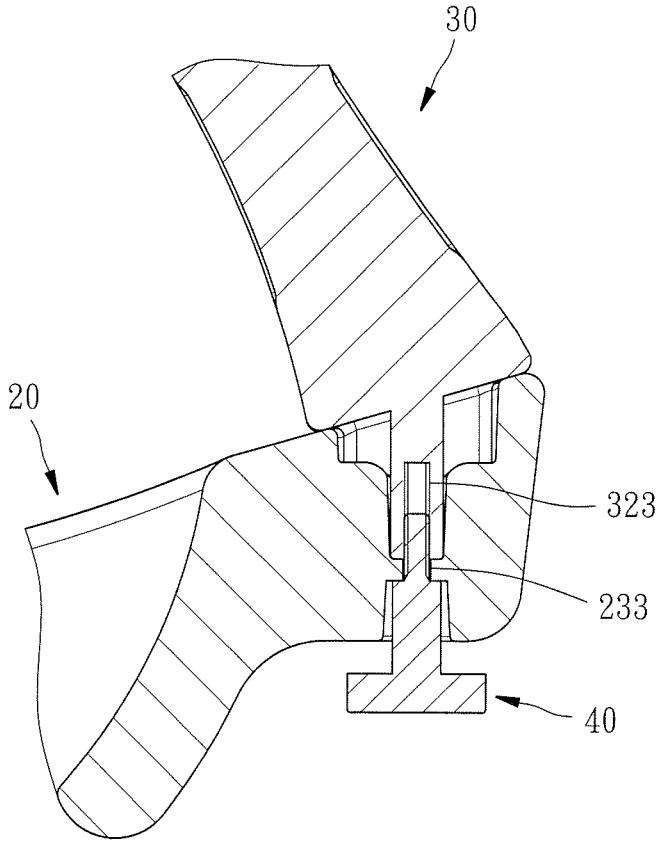
FIG. 5 is a sectional view of a part of the ball chair according to the embodiment of the present invention.

In the process of assembling the ball chair 1, the back 30 and the seat 20 are first connected with each other in a way that the engaging block 32 is inserted in the engaging recess 232, and then the back 30 and the seat 20 are fixed to each other by the two threaded fastening members 40 which are inserted upwards into the seat 20 and the back 30 from the bottom of the connecting portion 23 as shown in FIGS. 2, 4, and 5. Thereafter, the cushion 10 is placed on the bearing portion 21 of the seat 20 so as to complete assembly of the ball chair 1. It can be seen that the process of assembling the ball chair 1 is very easy and fast. The aforesaid steps for assembling the ball chair 1 are exemplary for this embodiment, not for limiting the scope of claims of the present invention. When the ball chair 1 is completely assembled, the back 30 is firmly secured to the seat 20 by the way that at least a part of the upper stop surface 31 of the back 30 is abutted against at least a part of the lower stop surface 231 of the seat 20, the relatively larger protrusions 321 and the relatively smaller protrusions 322 are all protruded from the upper stop surface 31 and accommodated correspondingly in the relatively larger cavities 234 and the relatively smaller cavities 235, and the seat 20 is fixed to the back 30 by the threaded fastening members 40. Therefore, the connection of the back 30 and the seat 20 is relatively less possible to be damaged by the pressure exerting on the back 30 by the back of the user who sits on the ball chair 1 and leans his/her back on the back 30, so that the back 30 is even lesser possible to be separated from the seat 20. Besides, the cushion 10 in this embodiment is approximately shaped like an elliptic ball, and the inner annular surface 211 of the bearing portion 21 is cone-shaped and defined with a space gradually narrowing from top to bottom. Therefore, when the cushion 10 is placed on the bearing portion 21, the position of the cushion 10 is restricted by the bearing portion 21. This means, the variation of the center of gravity or the posture of the user sitting on the ball chair 1 will not make the cushion 10 rotate on the seat 20. Besides, the elliptic-ball-shaped cushion is relatively more similar in shape to the human hips, so that the hips of the user will be supported more evenly. Therefore, the cushion 10 is conformable with ergonomics, and comfortable to the user who sits on the ball chair.

In other embodiments, the ball chair 1 may have some modifications different from the ball chair mentioned in the aforesaid embodiment. For example, the amount of the through hole 233, the threaded hole 323, the threaded fastening member 40, the relatively larger protrusion 321, the relatively smaller protrusion 322, the relatively larger cavity 234, the relatively smaller cavity 235, or the rib 324 may be only one at the least. However, the amount of each aforesaid structural feature is optimal to be more than one so that the ball chair 1 is configured stronger in structure. The ribs 324 are provided for connecting the relatively larger protrusions 321 and the relatively smaller protrusions 322 and providing supplementary stableness to the completely assembled ball chair 1. In fact, the back 30 may have no such ribs 324; in this case, the engaging recess 232 of the seat 20 may have no such passages 236. Alternately, the engaging recess 232 may have no such relatively larger cavities 234, relatively smaller cavities 235 and passages 236, as long as the engaging block 32 of the back 30 is still able to be inserted in the engaging recess 232 and the threaded holes 323 of the engaging block 32 still correspond in position to the through holes 233 of the connecting portion 23 for being engaged with the threaded fastening members 40 therein; in this case, the engaging block 32 of the back 30 may have no such ribs 324. The inner annular surface 211 of the bearing portion 21 may not be cone-shaped but configured as other shapes, such as cylindrical surface; in this case, the cushion may be shaped as a mushroom, such that the cushion will not fall down through the bearing portion 21. In other words, the shape of the cushion 10 can be changed according to actual situation. The bearing portion 21 may be configured as other shapes, such as a bowl-shape, for supporting the cushion 10. The inner annular surface 211 of the bearing portion 21 may not completely contact the cushion 10, which means there may be a gap between the inner annular surface 211 and the cushion 10. The positions of the through holes 233 and the threaded holes 323 may be changed according to actual situation, so that the threaded fastening members 40 can be inserted into the seat 20 and the back 30 from the left and right sides or other sides of the ball chair 1.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A ball chair comprising:

a cushion having a ball shape;

a seat having a bearing portion supporting the cushion, and a connecting portion connected with the bearing portion and provided with an engaging recess and at least a through hole communicated with the engaging recess;

a back having an engaging block inserted in the engaging recess and having at least two relatively larger protrusions spaced from each other, at least one relatively smaller protrusion located between said at least two relatively larger protrusions, and at least one threaded hole provided at said at least one relatively smaller protrusion and corresponding in position to the through hole of the connecting portion of the seat; and at least one threaded fastening member having a head and a body extended from the head, inserted through the through hole of the connecting portion and engaged in the threaded hole of the engaging block for fixing the back to the seat, wherein the engaging recess has at least two relatively larger cavities for accommodating said at least two relatively larger protrusions, and at least one relatively smaller cavity located between said at least two relatively larger cavities for accommodating said at least one relatively smaller protrusion; said at least one through hole is located in said at least one relatively smaller cavity.

2. The ball chair as claimed in claim 1, wherein the engaging block has two ribs extending from two sides of the relatively smaller protrusion respectively and connected with two adjacent said relatively larger protrusions.

3. The ball chair as claimed in claim 1, wherein the engaging block has two ribs extending from two sides of the relatively smaller protrusion respectively and connected with two adjacent said relatively larger protrusions; the engaging recess has two passages located at two sides of the relatively smaller cavity respectively and communicating with two adjacent said relatively larger cavities for accommodating said two ribs.

4. The ball chair as claimed in claim 1, wherein the back has an upper stop surface; the engaging block is protruded from the upper stop surface; the connecting portion of the seat has a lower stop surface; the engaging recess is concaved from the lower stop surface; at least a part of the upper stop surface is abutted against at least a part of the lower stop surface.

5. The ball chair as claimed in claim 1, wherein the bearing portion is ring-shaped.

6. The ball chair as claimed in claim 5, wherein the bearing portion has an inner annular surface in contact with a part of the cushion.

7. The ball chair as claimed in claim 6, wherein the inner annular surface of the bearing portion is cone-shaped and defined with a space gradually narrowing from top to bottom.

8. The ball chair as claimed in claim 6, wherein the cushion is shaped as an elliptic ball.

* * * * *